US009185499B2

(12) United States Patent
Gran et al.

(10) Patent No.: US 9,185,499 B2
(45) Date of Patent: Nov. 10, 2015

(54) BINAURAL HEARING AID WITH FREQUENCY UNMASKING

(75) Inventors: Karl-Fredrik J. Gran, Malmö (SE); Andrew B. Dittberner, Antioch, IL (US)

(73) Assignee: GN RESOUND A/S, Ballerup (DK)

( * ) Notice: Subject to any disclaimer, the term of this patent is extended or adjusted under 35 U.S.C. 154(b) by 224 days.

(21) Appl. No.: 13/547,720

(22) Filed: Jul. 12, 2012

(65) Prior Publication Data

US 2014/0010373 A1 Jan. 9, 2014

(30) Foreign Application Priority Data

Jul. 6, 2012 (DK) ..... 2012 70402
Jul. 6, 2012 (EP) ..... 12175247

(51) Int. Cl.
*H04R 25/00* (2006.01)

(52) U.S. Cl.
CPC ..... *H04R 25/50* (2013.01); *H04R 25/353* (2013.01); *H04R 25/43* (2013.01); *H04R 25/552* (2013.01); *H04R 25/407* (2013.01); *H04R 2225/43* (2013.01); *H04R 2430/03* (2013.01)

(58) Field of Classification Search
USPC ..... 381/92, 94
See application file for complete search history.

(56) References Cited

U.S. PATENT DOCUMENTS

| | | | | |
|---|---|---|---|---|
| 2008/0205677 | A1 | 8/2008 | Bauml et al. | |
| 2009/0304188 | A1 | 12/2009 | Mejia et al. | |
| 2010/0020981 | A1 * | 1/2010 | Elmedyb et al. | 381/71.11 |
| 2010/0067721 | A1 | 3/2010 | Tiefenau | |
| 2010/0183178 | A1 * | 7/2010 | Kellermann et al. | 381/317 |
| 2012/0148067 | A1 * | 6/2012 | Petersen et al. | 381/92 |

FOREIGN PATENT DOCUMENTS

| | | | |
|---|---|---|---|
| EP | 2 360 943 | A1 | 8/2011 |
| JP | 2009-206629 | A | 9/2009 |
| WO | 02/07479 | A1 | 1/2002 |
| WO | 2009/072040 | A1 | 6/2009 |
| WO | 2012/076044 | A1 | 6/2012 |

OTHER PUBLICATIONS

Extended European Search Report dated Oct. 30, 2012, for EP Patent Application No. 12175247.1.

(Continued)

*Primary Examiner* — Duc Nguyen
*Assistant Examiner* — Phan Le
(74) *Attorney, Agent, or Firm* — Vista IP Law Group, LLP

(57) ABSTRACT

A hearing aid includes: at least one microphone for provision of at least one microphone audio signal in response to sound received at the at least one microphone; a signal separation unit configured to provide an estimate of a target signal and an estimate of a masker signal based on the at least one microphone audio signal; a frequency modifying unit configured to modify a frequency content of at least one of the estimate of the target signal and the estimate of the masker signal, to thereby output the estimated target signal and the estimated masker signal substantially in different frequency bands; and a receiver for conversion of a combination of the estimate of the target signal and the estimate of the masker signal output by the frequency modifying unit into an acoustic signal for transmission towards an eardrum of a user of the hearing aid.

20 Claims, 9 Drawing Sheets

(56) References Cited

OTHER PUBLICATIONS

Klaus Reindl et al., "Speech Enhancement for Binaural Hearing Aids based on Blind Source Separation", Proceedings of the 4th International Symposium on Communications, Control and Signal Processing, ISCCSP 2010, Limassol, Cyprus, Mar. 3-5, 2010, IEEE, Piscataway, NJ, USA, Mar. 3, 2010, 6 pages.

1st Technical Examination dated Jan. 14, 2013, for DK Patent Application No. PA 2012 70402.

Search report dated Jan. 14, 2013, for DK Patent Application No. PA 2012 70402.

Foreign Office Action for JP Patent Application No. 2012-279621 dated Nov. 25, 2014, 4 pages.

* cited by examiner

BINAURAL HEARING AID WITH FREQUENCY UNMASKING

RELATED APPLICATION DATA

This application claims priority to, and the benefit of, Danish Patent Application No. PA 2012 70402, pending, filed on Jul. 6, 2012, and European Patent Application No. 12175247.1, pending, filed on Jul. 6, 2012, the entire disclosures of which are expressly incorporated by reference herein.

FIELD OF TECHNOLOGY

A new binaural hearing aid system is provided that compensates for a hearing impaired user's loss of ability to understand speech in noise.

BACKGROUND

Hearing impaired individuals often experience at least two distinct problems: a hearing loss, which is an increase in hearing threshold level, and a loss of ability to understand high level speech in noise in comparison with normal hearing individuals. For most hearing impaired patients, the performance in speech-in-noise intelligibility tests is worse than for normal hearing people, even if the audibility of the incoming sounds is restored by amplification. An individual's speech reception threshold (SRT) is the signal-to-noise ratio required in a presented signal to achieve 50 percent correct word recognition in a hearing in noise test.

Today's digital hearing aids that use multi-channel amplification and compression signal processing can readily restore audibility of amplified sound for a hearing impaired individual. The patient's hearing ability can thus be improved by making previously inaudible speech cues audible.

Loss of capability to understand speech in noise is the most significant problem of most hearing aid users today. The traditional way of increasing SRT in hearing instruments, is to apply either beamforming or spectral subtraction techniques.

In the first case, at least one microphone in combination with a number of filters, fixed or adaptive, is used to enhance a signal from the presumed target direction and at the same time suppress all other signals.

In spectral subtraction techniques, the goal is to create an estimate of the long term noise spectrum and turn down gain in frequency bands where the instantaneous target signal power is lower than the long term noise power. Even though the methods are very different from a technological standpoint, they still have the common goal; enhance the target signal and remove the noise disturbance.

The methods cannot take listener intent into account and may remove parts of the audio signal which the listener is trying to focus on.

SUMMARY

Below, a new and inventive method of enhancement of a target signal is disclosed. The new method makes use of the human auditory system's capability of concentrating on a target signal. A new and inventive binaural hearing aid system using the new method is also disclosed.

Throughout the present disclosure, a target signal is a signal representing sound that a person desires to listen to.

Speech, music, and sounds from the nature are examples of target signals.

Throughout the present disclosure, a masker signal is also a signal representing sound; however, sound that a person perceives to be interfering with the target signal in an undesirable way, e.g. making it difficult for the person to understand or enjoy the target signal.

The masker signal can be background speech, restaurant clatter, music (when speech is the target signal), traffic noise, etc.

Listening in complex sound fields is to a large extent facilitated by binaural processing in the auditory system. Due to diffraction effects by the pinna, concha, head and torso and due to reflection effects in reverberant environments, cues are imparted to the sound field, and are highly individual for the given subject.

The most important cues in binaural processing are interaural time differences (ITD) and interaural level differences (ILD). The ITD results from the difference in distance from the source to the two ears. This cue is primarily useful up till approximately 1.5 kHz and above this frequency the auditory system can no longer resolve the ITD cue.

The level difference is a result of diffraction and is determined by the relative position of the ears compared to the source. This cue is dominant above 2 kHz but the auditory system is equally sensitive to changes in ILD over the entire spectrum.

It has been argued that hearing impaired subjects benefit the most from the ITD cue as the hearing loss tends to be less severe in the lower frequencies.

In the new binaural hearing aid, speech intelligibility is increased by outputting the target signal and the masker signal to the eardrums of a user of the binaural hearing aid in different frequency bands.

In this way, energetic masking caused by simultaneous presence of the target signal and the masker signal is reduced by separation of the signals into different frequency bands.

It has been shown that for speech as the target signal and Gaussian noise as the masker signal, 15 dB SRT improvement can be obtained for listeners with normal hearing and approximately 10 dB SRT improvement for hearing impaired listeners.

The improvement is obtained without removal a part of the signal; rather, the target and masker signals are presented to the eardrums of the user in a way that the auditory system of the user's auditory system can perform natural noise reduction and separate the target signal from the masker signal.

Thus, a new hearing aid is provided, comprising at least one microphone for provision of at least one microphone audio signal in response to sound received at the at least one microphone, a signal separation unit configured to provide an estimate of a target signal and a masker signal based on the at least one microphone audio signal, a frequency modifying unit configured to modify the frequency content of at least one of the estimates of the target signal and the masker signal so that, upon processing by the frequency modifying unit, the estimated target signal and the estimated masker signal are output substantially in different frequency bands, a receiver for conversion of a combination of the estimate of the target signal and the estimate of the masker signal as modified and output by the frequency modifying unit into an acoustic signal for transmission towards one of the eardrums of a user of the binaural hearing aid system.

In one embodiment, two signals are said to be output substantially in different frequency bands of the hearing aid, when in a majority of the frequency bands, e.g. in more than 51% of the frequency bands of the hearing aid, and in a major part of the time, e.g. in more than 51% of the time; one of the signals, e.g. the target signal, in one of the frequency bands, and the other one of the signals, e.g. the masker signal, in another one of the frequency bands, have a signal level that is less than 20%, such as less than 15%, preferably less than 10%, more preferred less than 5%, most preferred less than 1% of the signal level of the other signal.

The signal level may be an RMS-value, a peak value, an average amplitude value, etc, as defined in a predetermined time period.

The new hearing aid may constitute a first hearing aid of a new binaural hearing aid system further having a second hearing aid comprising at least one microphone for provision of respective at least one microphone audio signal in response to sound received at the at least one microphone, and wherein a transceiver in the second hearing aid is connected for transmission of signals representing the at least one microphone audio signal to the first hearing aid, and wherein a transceiver in the first hearing aid is connected for reception of the signals representing the at least one microphone audio signal of the second hearing aid, and wherein the signal separation unit is configured to provide the estimate of the target signal and the estimate of the masker signal based on the at least one microphone audio signals of the first and second hearing aids.

Further, a new and inventive method is provided, comprising the steps of: providing at least one microphone audio signal in response to sound, and providing an estimate of a target signal and a masker signal based on the at least one audio signal, frequency modifying at least one of the estimate of the target signal and the estimate of the masker signal in such a way that the estimate of the target signal and the estimate of the masker signal as modified substantially reside in different frequency bands, and transmitting a combination of the estimate of the target signal and the estimate of the masker signal as modified towards one of the eardrums of a person.

The frequency modifying unit may be configured to frequency shift one of the estimate of the target signal and the estimate of the masker signal into a frequency region where the other one of the estimate of the target signal and the estimate of the masker signal substantially is not present.

Further or alternatively, the frequency modifying unit may be configured to determine pitch and harmonics of the estimate of the target signal and the estimate of the masker signal, respectively, and frequency shift one of the estimate of the target signal and the estimate of the masker signal so that pitch and harmonics of the frequency shifted signal resides in between respective pitch and harmonics of the other signal.

Further or alternatively, the frequency modifying unit may comprise a filter-bank, and the frequency modifying unit may be configured to filter the estimate of the target signal with frequency bands assigned to the estimate of the target signal, and filter the estimate of the masker signal with other frequency bands assigned to the estimate of the masker signal.

The filter-bank may be tuned to the auditory filters of the intended user.

It has also been shown that manipulating the relative interaural phase and level of a target signal, i.e. a signal a listener desires to listen to, and of a masker signal, i.e. a signal the listener perceives as disturbing, can improve speech intelligibility significantly. It seems as if the auditory system is indeed adapted to separate signals with different ITD and ILD encoding to perform a natural type of masker reduction to facilitate focusing on the target signal.

It has been found that if the target signal is presented in anti-phase, i.e. phase shifted 180°, and the masker signal in-phase in the two ears, an increase of the Binaural Masking Level Difference (BMLD) of 13 dB can be achieved compared to when both signals are presented in-phase in the two ears. Depending on the type of masker signal, an improvement of 20 dB of the BMLD is achievable.

The reverse situation where the masker signal is presented out of phase and the target signal is presented in phase yields a slightly lower performance.

Thus, the frequency modifying unit may also be configured to phase shift the estimate of the target signal with relation to the estimate of the masker signal.

In this way, a user's capability of understanding speech in noise is further improved.

For example, if the target signal is designated S and the masker signal is designated N, the incoming sound signal is S+N. Based on the sound signal S+N, the target signal S is estimated, and the estimate is denoted ES. An estimate of the masker signal N is designated EN and may be determined by subtracting the estimate ES from the sound signal S+N.

In the following S, N, ES, EN designates each of the signals before frequency modification, or each of the signals after frequency modification, in the frequency modifying unit.

The estimate of the target signal ES may be phase shifted 180° with relation to the estimate of the masker signal EN by subtracting two times ES from the incoming signal S+N with the result: S+N−ES−ES. Since ES is approximately equal to S, the result of the subtraction is approximately: N−ES which is approximately equal to −ES+EN, i.e. the estimate of the target signal ES has been phase shifted substantially by 180° with relation to the estimate of the masker signal. This operation may be performed before or after frequency modification in the frequency modifying unit.

It should be noted that a phase shift of exactly or approximately 180° is not required in order to obtain a significant improvement of SRT; rather such improvement is obtained with phase shift in the range from 135°-225°, such as from 150°-210°.

Now, the original signal S+N may be presented to one ear of a user, and the phase shifted signal N−ES, or more accurately S+N−2ES, may be presented to the other ear for improved BMLD and SRT as disclosed above.

Alternatively, both the target signal S and the masker signal N may be estimated and the sum of the estimates ES+EN may be presented to one ear of the user, and the phase shifted sum −ES+EN may be presented to the other ear for improved BMLD and SRT as disclosed above. This operation may be performed before or after frequency modification in the frequency modifying unit.

The target signal S and the masker signal may be swapped so that the masker signal estimate is phase shifted instead of the target signal for improved BMLD and SRT as disclosed above; however with decreased performance compared to phase shifting the target signal S.

Throughout the present disclosure, one signal is said to represent another signal when the one signal is a function of the other signal, for example the one signal may be formed by analogue-to-digital conversion, or digital-to analogue conversion of the other signal; or, the one signal may be formed by conversion from another acoustic signal to an electronic signal or vice versa; or the one signal may be formed by analogue or digital filtering or mixing of the other signal; or the one signal may be formed by transformation, such as frequency transformation, etc, of the other signal; etc.

Further, signals that are processed by specific circuitry, e.g. in a signal processor, may be identified by a name that may be used to identify any analogue or digital signal forming part of the signal path from the source of the signal in question to an input of the circuitry, e.g. signal processor, in question. For example an output signal of a microphone, i.e. the microphone audio signal, may be used to identify any analogue or digital signal forming part of the signal path from the output of the microphone to its input to the signal processor, including pre-processed microphone audio signals.

The at least one microphone may consist of a single microphone; however preferably, the at least one microphone comprises a single microphone, e.g. a plurality of microphones, such as two microphones. The at least one microphone may have more than two microphones for improved separation of the target signal and the masker signal.

For improved signal enhancement, the second hearing aid may also comprise at least one microphone for provision of microphone audio signals in response to sound received at the respective microphones. In this case, the transceiver of the first hearing aid is connected for reception of signals representing the microphone audio signals of the second hearing aid, and the signal separation unit is configured to provide the estimate of the target signal and the estimate of the masker signal based on the audio signals of the first and second hearing aids.

Preferably, the frequency modifying unit phase shifts the estimate of the target signal with relation to the estimate of the masker signal with a phase shift ranging from 150° to 210°, more preferred the phase shift is approximately equal to 180°, and most preferred equal to 180°.

The improvement of SRT as a function of the phase shift has a maximum at 180°; however the function is sine-shape with a flat maximum so that the improvement obtained by a phase shift ranging from 150° to 210° is close to the maximum improvement. Thus, the phase shift need not be exactly 180°, but preferably has a value within the range from 135° to 225°, more preferred from 150° to 210°.

Preferably, the target estimate is presented in opposite phase, i.e. 180° phase shifted with relation to each other, at the two ears of the user, while the masker signal estimate is presented in phase at the two ears of the user.

The signal separation unit may be configured to provide the estimates based on spectral characteristics of the audio signals as is well-known in the art of noise reduction. However, according to the new method, the masker signal estimate is not suppressed in the output presented to the user; rather the target estimate and the masker signal estimate is presented to the user in a way that improves the user's SRT as disclosed above.

The signal separation unit may be configured to provide the estimates based on statistical characteristics of the audio signals as is well-known in the art of noise reduction. However, according to the new method, the masker signal estimate is not suppressed in the output presented to the user; rather the target estimate and the masker signal estimate is presented to the user in a way that improves the user's SRT.

The signal separation unit may comprise a beamformer, and the beam former may be configured to provide the estimates based on microphone audio signals of the first and second hearing aids. The beamformer of the signal separation unit is different from conventional beamformers in that the masker signal estimate is not suppressed in the output presented to the user; rather the target estimate and the masker signal estimate is presented to the user in a way that improves the user's SRT.

The beamformer combines the microphone audio signals output by the plurality of microphones into a target signal with varying sensitivity to sound sources in different directions in relation to the plurality of microphones. Throughout the present disclosure, a plot of the varying sensitivity as a function of the direction is denoted the directivity pattern. Typically, a directivity pattern has at least one direction wherein the microphone signals substantially cancel each other. Throughout the present disclosure, such a direction is denoted a null direction. A directivity pattern may comprise several null directions depending on the number of microphones of the plurality of microphones and depending on the signal processing.

The beamformer may be a fixed beamformer with a directional pattern that is fixed with relation to the head of the user. The beamformer may for example be based on at least two microphones, with a directional pattern that has a maximum in the front direction of the user, i.e. the forward looking direction of the user, and a null in the opposite direction, i.e. the rear direction of the user.

The beamformer may be based on more than two microphones, and may include microphones of both hearing aids using wireless or wired communication techniques. The increased distance between the microphones may be utilized to form a directional pattern with a narrow beam providing improved spatial separation of the target estimate from the masker signal estimate. The conventional output of the beamformer may be used as the target estimate, and the masker signal estimate may be provided by subtraction of the target estimate from the microphone audio signal of one of the microphones of the plurality of microphones.

When microphones of both hearing aids of the binaural hearing aid system cooperate with the beamformer, the respective microphone signals must be sampled substantially synchronously. Time shifts as small as 20-30 μS between sampling instants of the respective microphone signals in the two hearing aids may lead to a perceivable shift in the beam direction. Furthermore, a slowly time varying time shift between the sampling instants of the respective microphone signals, which inevitably will occur if the hearing aids are operated asynchronously, will result in an acoustic beam that appears to drift and focus in alternating directions.

Thus, the hearing aids of the binaural hearing aid system may be synchronized as for example discloses in more detail in WO 02/07479.

The beamformer may comprise adaptive filters configured to filter respective microphone audio signals and to adapt the respective filter coefficients for adaptive beamforming towards a sound source. For example, the beamformer may adapt to optimize the signal to noise ratio.

An adaptable beamformer makes it possible to focus on a moving sound source or to focus on a non-moving sound source, while the user of the hearing aid system is moving. Furthermore, the adaptable beamformer is capable of adapting to changes in the sound environment, such as appearance of a new sound source, disappearance of a masker signal or noise source or movement of masker signal or noise sources relative to the user of the hearing aid system.

An adaptive beamformer may be designed under the assumption that the signals received at the at least one microphone can be modelled as a combination of a target signal from a pre-determined target direction plus masker or noise:

$$y(n)=h_i(n)*s(n)+v_i(n)$$

where $h_i(n)$ is the impulse response of sound propagation from the source emitting the signal s(n) to the $i^{th}$ microphone and $v_i(n)$ is the masker signal at the same microphone. The masker signal can consist of both directional noise and other types of noise such as diffuse noise or babble noise.

The filter coefficients may adaptively be determined by solving the following optimization problem:

$$\{a_i(n)\}_{i=1}^{4} = \arg \min_{\{a_i(n)\}_{i=1}^{4}} \|z(n)\|^2$$

subject to $$\sum_{i=1}^{4} a_i(n) * h_i(n) = h_1(n)$$

Finding a solution to this optimization could be done adaptively using least mean square, recursive least square, steepest descent or other types of numerical optimization algorithms.

Preferably, the signal separation unit is configured in such a way that the estimate of the target signal and the estimate of the masker signal include the spatial cues of the original signal. This can be achieved by appropriate microphone placements and/or proper pre/post processing of the microphone signals.

Each of the hearing aids of the binaural hearing aid may have a signal separation unit so that an estimate of the target signal and an estimate of the masker signal are available in each of the hearing aids, preferably with correct spatial cues.

Once the target and masker signal estimate has been determined, the signals are presented to the user in such a way that the SRT of the user is improved as disclosed above.

The new binaural hearing aid system may comprise a multi-channel first hearing aid in which the microphone audio signals are divided into a plurality of frequency channels.

Correspondingly, individual target signal estimates and masker signal estimates may be provided in each frequency channel of the plurality of frequency channels, or may be provided in one or more selected frequency channels of the plurality of frequency channels, or one or more target signal estimates and masker signal estimates may be provided for one or more respective groups of selected frequency channels of the plurality of frequency channels, or one target signal estimate and masker signal estimate may be provided based on all the frequency channels of the plurality of frequency channels.

The plurality of frequency channels may include warped frequency channels, for example all of the frequency channels may be warped frequency channels.

The new binaural hearing aid system may additionally provide circuitry used in accordance with other conventional methods of hearing loss compensation so that the new circuitry or other conventional circuitry can be selected for operation as appropriate in different types of sound environment. The different sound environments may include speech, babble speech, restaurant clatter, music, traffic noise, etc.

The new binaural hearing aid system may for example comprise a Digital Signal Processor (DSP), the processing of which is controlled by selectable signal processing algorithms, each of which having various parameters for adjustment of the actual signal processing performed. The gains in each of the frequency channels of a multi-channel hearing aid are examples of such parameters.

One of the selectable signal processing algorithms operates in accordance with the new method.

For example, various algorithms may be provided for conventional noise suppression, i.e. attenuation of undesired or noise signals and amplification of target signals.

Microphone audio signals obtained from different sound environments may possess very different characteristics, e.g. average and maximum sound pressure levels (SPLs) and/or frequency content. Therefore, each type of sound environment may be associated with a particular program wherein a particular setting of algorithm parameters of a signal processing algorithm provides processed sound of optimum signal quality in a specific sound environment. A set of such parameters may typically include parameters related to broadband gain, corner frequencies or slopes of frequency-selective filter algorithms and parameters controlling e.g. knee-points and compression ratios of Automatic Gain Control (AGC) algorithms.

Signal processing characteristics of each of the algorithms may be determined during an initial fitting session in a dispensers office and programmed into the new binaural hearing aid system in a non-volatile memory area.

The new binaural hearing aid system may have a user interface, e.g. buttons, toggle switches, etc, of the hearing aid housings, or a remote control, so that the user of the new binaural hearing aid system can select one of the available signal processing algorithms to obtain the desired hearing loss compensation in the sound environment in question.

The new binaural hearing aid system may be capable of automatically classifying the users sound environment into one of a number of sound environment categories, such as speech, babble speech, restaurant clatter, music, traffic noise, etc, and may automatically select the appropriate signal processing algorithm accordingly as known in the art.

In accordance with some embodiments, a hearing aid includes: at least one microphone for provision of at least one microphone audio signal in response to sound received at the at least one microphone; a signal separation unit configured to provide an estimate of a target signal and an estimate of a masker signal based on the at least one microphone audio signal; a frequency modifying unit configured to modify a frequency content of at least one of the estimate of the target signal and the estimate of the masker signal, to thereby output the estimated target signal and the estimated masker signal substantially in different frequency bands; and a receiver for conversion of a combination of the estimate of the target signal and the estimate of the masker signal output by the frequency modifying unit into an acoustic signal for transmission towards an eardrum of a user of the hearing aid.

In accordance with other embodiments, a method of signal enhancement in a hearing aid includes: providing at least one microphone audio signal in response to sound; providing an estimate of a target signal and an estimate of a masker signal based on the at least one audio signal; frequency modifying at least one of the estimate of the target signal and the estimate of the masker signal, so that the estimate of the target signal and the estimate of the masker signal substantially reside in different frequency bands; and transmitting a combination of the estimate of the target signal and the estimate of the masker signal that reside in different frequency bands towards an eardrum of a user of the hearing aid.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. Like elements will, thus, not be described in detail with respect to the description of each figure. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting in the scope of the claims.

DESCRIPTION OF THE EMBODIMENTS

Figure 1:
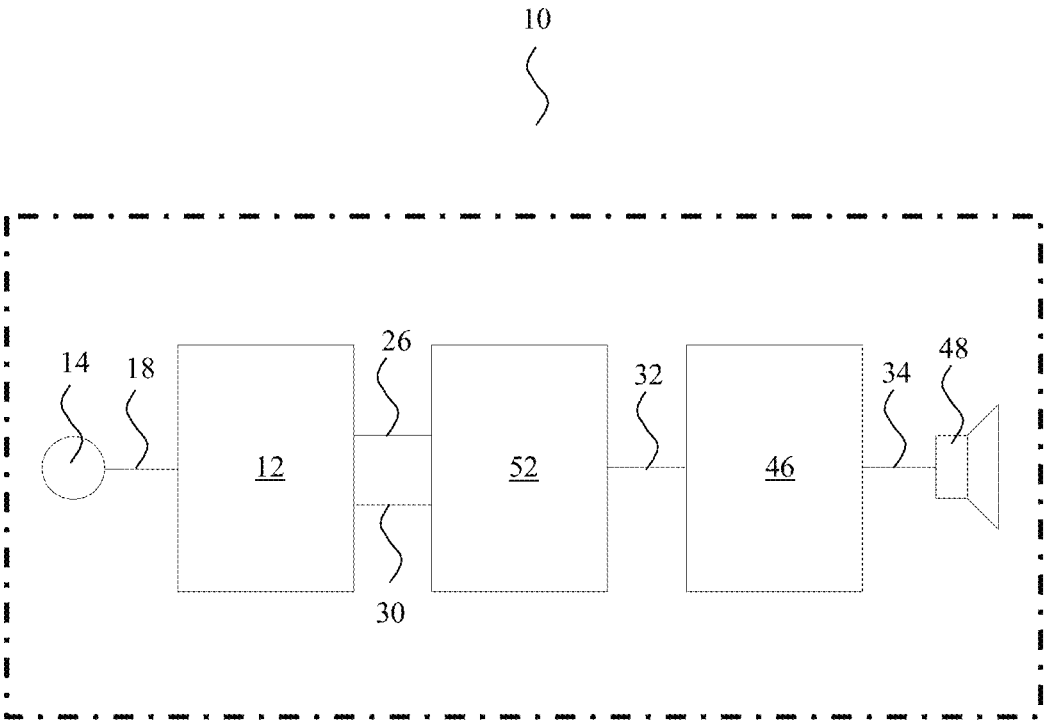
FIG. 1 schematically illustrates an exemplary new hearing aid.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. Thus, the claimed invention may be embodied in different forms not shown in the figures. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or not so explicitly described.

FIG. 1 schematically illustrates an example of the new binaural hearing aid 10 that operates to enhance a target signal making use of the human auditory system's capability of concentrating on a target signal.

In the illustrated new hearing aid 10, speech intelligibility is increased by outputting a target signal and a masker signal to the eardrums of a user of the binaural hearing aid in different frequency bands.

In this way, energetic masking caused by simultaneous presence of the target signal and the masker signal is reduced by separation of the signals into different frequency bands.

It has been shown that for speech as the target signal and Gaussian noise as the masker signal, 15 dB SRT improvement can be obtained for listeners with normal hearing and approximately 10 dB SRT improvements for hearing impaired listeners.

The improvement is obtained without removal of a part of the signal; rather, the target and masker signals are presented to the eardrums of the user in a way that the auditory system of the user's auditory system can perform natural noise reduction and separate the target signal from the masker signal.

The illustrated new hearing aid 10 comprises a microphone 14 for provision of a microphone audio signal 18 in response to sound received at the microphone 14. The microphone audio signal 18 may be pre-filtered in respective pre-filters (not shown) well-known in the art, and input to the signal separation unit 12.

The signal separation unit 12 is configured to provide an estimate of a target signal 26 and a masker signal 30 based on the microphone audio signal 18, a frequency modifying unit 52 configured to modify the frequency content of at least one of the estimates of the target signal 26 and the masker signal 30 so that, upon processing by the frequency modifying unit 52, the estimated target signal 26 and the estimated masker signal 30 are output substantially in different frequency bands.

A hearing loss processor 46 configured for hearing loss compensation as is well-known in the art of hearing aids processes a combination 32 of the estimated target signal 26 and estimated masker signal 30 as modified by the frequency modifying unit 52 into a hearing loss compensated audio signal 34, and an output transducer 48, in the illustrated example a receiver 48, converts the output 34 of the hearing loss processor 46 into an acoustic output signal that is transmitted towards the eardrum of the user wearing the hearing aid 10.

Figure 2:
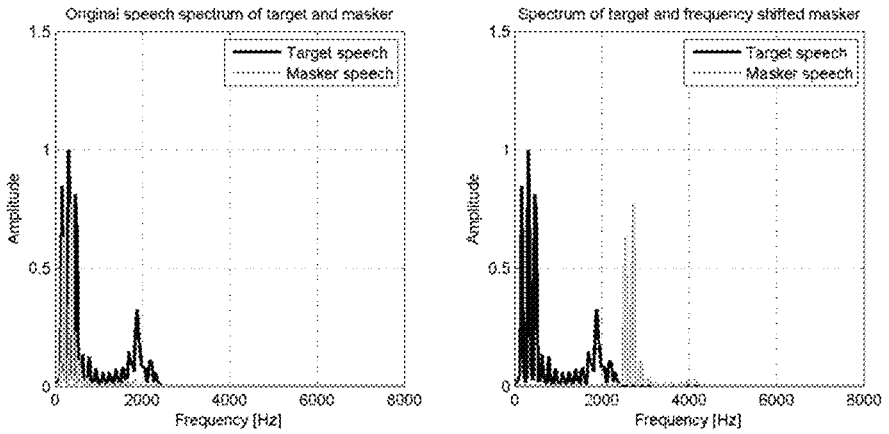
FIG. 2 shows a plot of a frequency shifted masker signal.

The frequency modifying unit 52 may be configured to frequency shift one of the estimate of the target signal 26 and the estimate of the masker signal 30 into a frequency region where the other one of the estimate of the target signal 26 and the estimate of the masker signal 30 substantially is not present as illustrated in FIG. 2 showing a frequency shifted estimated masker signal 30.

Figure 3:
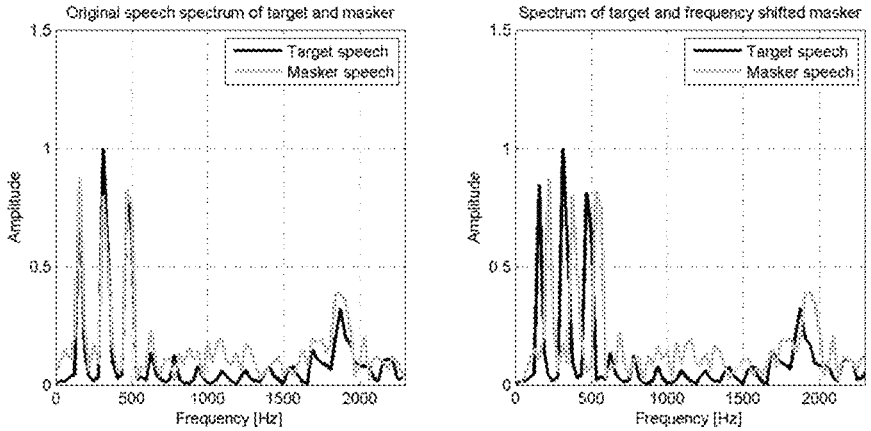
FIG. 3 shows another plot of a frequency shifted masker signal.

Further or alternatively, the frequency modifying unit 52 may be configured to determine pitch and harmonics of the estimate of the target signal 26 and the estimate of the masker signal 30, respectively, and frequency shift one of the estimate of the target signal 26 and the estimate of the masker signal 30 so that pitch and harmonics of the frequency shifted signal resides in between respective pitch and harmonics of the other signal as illustrated in FIG. 3.

Figure 4:
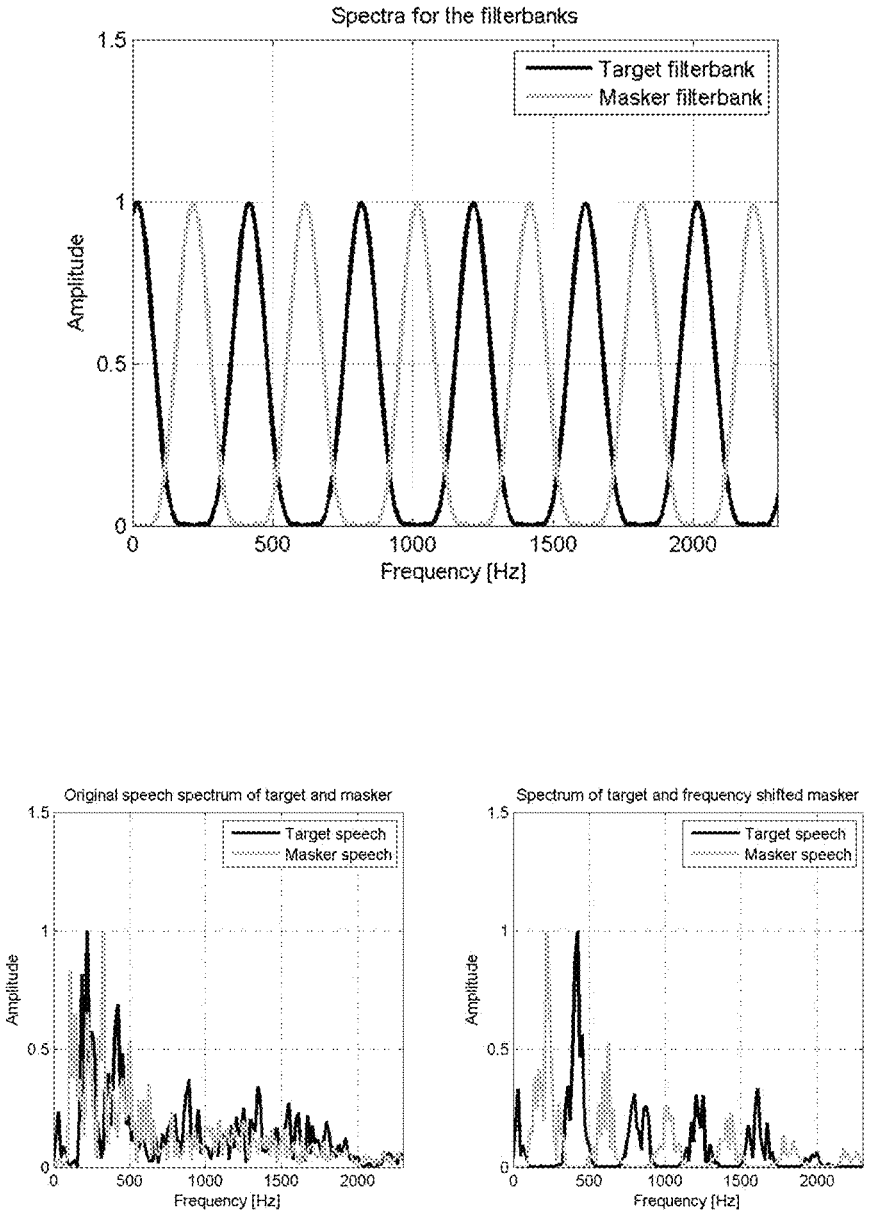
FIG. 4 shows a plot of bandpass filters and bandpass filtered target and masker signals, FIG. 5 schematically illustrates an exemplary new binaural hearing aid system, FIG. 6 schematically illustrates an exemplary new binaural hearing aid system, FIG. 7 schematically illustrates a signal separation unit with an adaptive beamformer based on two microphones, FIG. 8 schematically illustrates a signal separation unit based on four microphones, and FIG. 9 schematically illustrates an exemplary new binaural hearing aid system.

Further or alternatively, the frequency modifying unit 52 may comprise a filter-bank as shown in FIG. 4, and the frequency modifying unit 52 may be configured to filter the estimate of the target signal with frequency bands assigned to the estimate of the target signal 26, and filter the estimate of the masker signal 30 with other frequency bands assigned to the estimate of the masker signal 30.

The filter-bank may be tuned to the auditory filters of the intended user.

In this way, a user's capability of understanding speech in noise is improved.

The masker signal can be background speech, restaurant clatter, music (when speech is the target signal), traffic noise, etc.

The microphone 14 may be substituted with two microphones, or an array of microphones with more than two microphones for improved separation of the target signal and the masker signal.

The signal separation unit 12 may be configured to provide the estimates based on spectral characteristics of the audio signals as is well-known in the art of noise reduction. However, according to the new method, the masker signal estimate is not suppressed in the output presented to the user; rather the target estimate and the masker signal estimate is presented to the user in a way that improves the user's SRT.

The signal separation unit 12 may be configured to provide the estimates based on statistical characteristics of the audio signals as is well-known in the art of noise reduction. However, according to the new method, the masker signal estimate is not suppressed in the output presented to the user; rather the target estimate and the masker signal estimate is presented to the user in a way that improves the user's SRT.

The signal separation unit 12 may comprise a beamformer. The beamformer of the signal separation unit 12 is different from conventional beamformers in that the masker signal estimate is not suppressed in the output presented to the user;

rather the target estimate and the masker signal estimate is presented to the user in a way that improves the user's SRT.

The beamformer may be a fixed beamformer with a directional pattern that is fixed with relation to the head of the user. The beamformer may for example be based on at least two microphones, with a directional pattern that has a maximum in the front direction of the user, i.e. the forward looking direction of the user, and a null in the opposite direction, i.e. the rear direction of the user.

The beamformer may be based on more than two microphones. The conventional output of the beamformer may be used as the target estimate, and the masker signal estimate may be provided by subtraction of the target estimate from the microphone audio signal of one of the microphones of the plurality of microphones.

The beamformer may comprise adaptive filters configured to filter respective microphone audio signals and to adapt the respective filter coefficients for adaptive beamforming towards a sound source. For example, the beamformer may adapt to optimize the signal to noise ratio.

As explained above, an adaptable beamformer makes it possible to focus on a moving sound source or to focus on a non-moving sound source, while the user of the hearing aid system is moving. Furthermore, the adaptable beamformer is capable of adapting to changes in the sound environment, such as appearance of a new sound source, disappearance of a masker signal or noise source or movement of masker signal or noise sources relative to the user of the hearing aid system.

Preferably, the signal separation unit is configured in such a way that the estimate of the target signal and the estimate of the masker signal include the spatial cues of the original signal. This can be achieved by appropriate microphone placements and/or proper pre/post processing of the microphone signals.

Once the target and masker signal estimate has been determined, the signals are presented to the user in such a way that the SRT of the user is improved.

The new hearing aid 10 may be a multi-channel hearing aid in which the microphone audio signals are divided into a plurality of frequency channels.

Correspondingly, individual target signal estimates and masker signal estimates may be provided in each frequency channel of the plurality of frequency channels, or may be provided in one or more selected frequency channels of the plurality of frequency channels, or one or more target signal estimates and masker signal estimates may be provided for one or more respective groups of selected frequency channels of the plurality of frequency channels, or one target signal estimate and masker signal estimate may be provided based on all the frequency channels of the plurality of frequency channels.

The plurality of frequency channels may include warped frequency channels, for example all of the frequency channels may be warped frequency channels.

The new hearing aid 10 may additionally provide circuitry 46 used in accordance with other conventional methods of hearing loss compensation so that the new circuitry or other conventional circuitry can be selected for operation as appropriate in different types of sound environment. The different sound environments may include speech, babble speech, restaurant clatter, music, traffic noise, etc.

The new hearing aid 10 may for example comprise a Digital Signal Processor (DSP), the processing of which is controlled by selectable signal processing algorithms, each of which having various parameters for adjustment of the actual signal processing performed. The gains in each of the frequency channels of a multi-channel hearing aid are examples of such parameters.

One of the selectable signal processing algorithms operates in accordance with the disclosed method of signal enhancement.

For example, various algorithms may be provided for conventional noise suppression, i.e. attenuation of undesired or noise signals and amplification of target signals.

Microphone audio signals obtained from different sound environments may possess very different characteristics, e.g. average and maximum sound pressure levels (SPLs) and/or frequency content. Therefore, each type of sound environment may be associated with a particular program wherein a particular setting of algorithm parameters of a signal processing algorithm provides processed sound of optimum signal quality in a specific sound environment. A set of such parameters may typically include parameters related to broadband gain, corner frequencies or slopes of frequency-selective filter algorithms and parameters controlling e.g. knee-points and compression ratios of Automatic Gain Control (AGC) algorithms.

Signal processing characteristics of each of the algorithms may be determined during an initial fitting session in a dispensers office and programmed into the new binaural hearing aid system in a non-volatile memory area.

The new hearing aid 10 may have a user interface, e.g. buttons, toggle switches, etc, of the hearing aid housings, or a remote control, so that the user of the new binaural hearing aid system can select one of the available signal processing algorithms to obtain the desired hearing loss compensation in the sound environment in question.

The new hearing aid 10 may be capable of automatically classifying the users sound environment into one of a number of sound environment categories, such as speech, babble speech, restaurant clatter, music, traffic noise, etc, and may automatically select the appropriate signal processing algorithm accordingly as known in the art.

Figure 5:
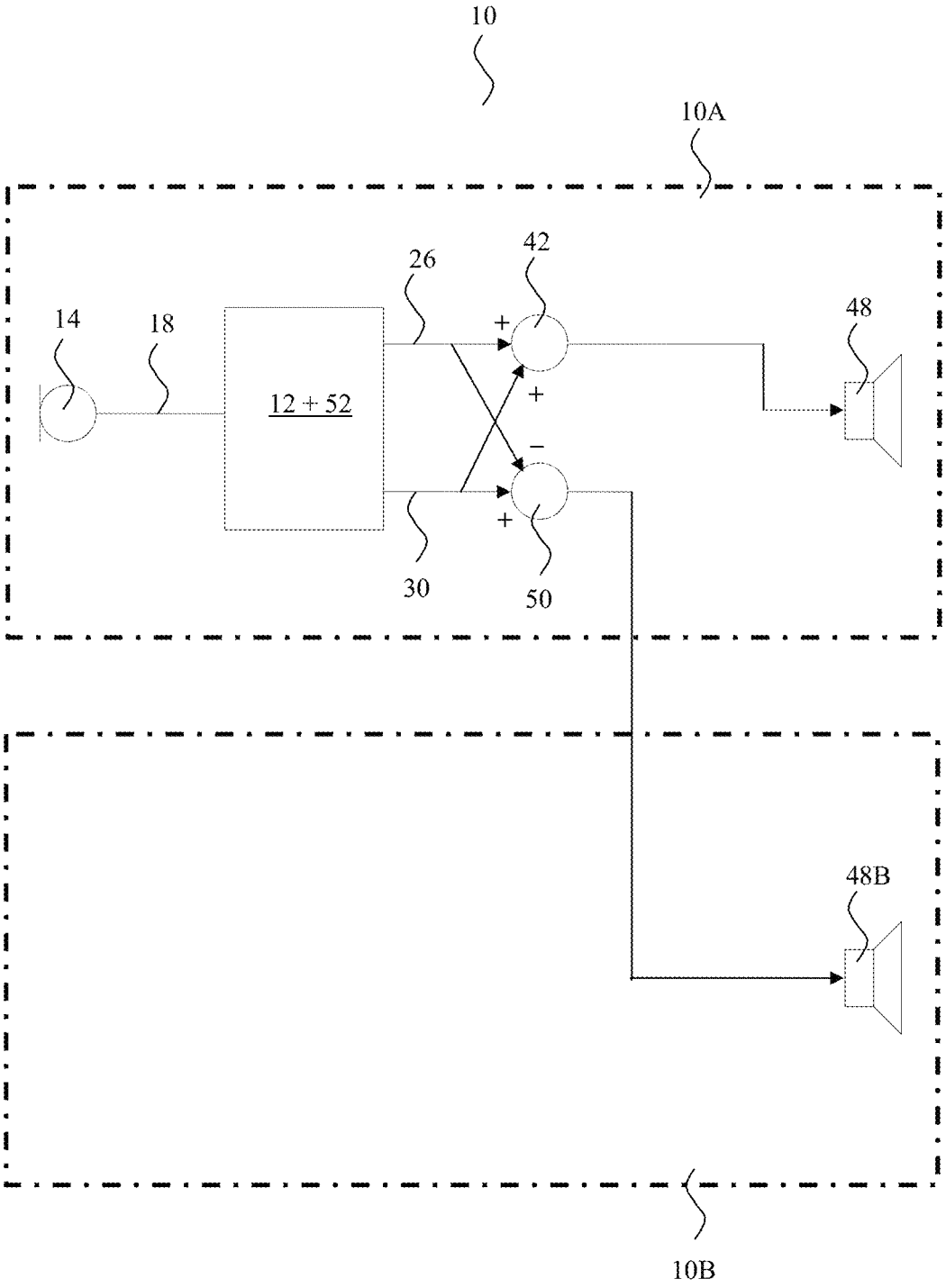

FIG. 5 shows a new binaural hearing aid system 10 with first and second hearing aids 10A, 10B. The second hearing aid 10B has a receiver 48B and a transceiver (not shown) for reception of the input signal to the receiver 48B from the first hearing aid 10A by wired or wireless transmission. Thus, in the illustrated example, the acoustic output signal emitted by the second hearing aid 10B is controlled by the first hearing aid 10A.

The first hearing aid 10A comprises one microphone 14 for provision of microphone audio signal 18 in response to sound received at the microphone 14. The microphone audio signal 18 may be pre-filtered in respective pre-filters (not shown) well-known in the art, and input to the signal separation unit 12. The signal separation unit 12 provides an estimate of the target signal 26 and an estimate of the masker signal 30 based on the possibly pre-filtered microphone audio signal 18 and outputs the estimates to the frequency modifying unit 52.

The frequency modifying unit 52 modifies the frequency content of the estimates of the target signal 26 and the masker signal 30 so that the estimated target signal 26 and the estimated masker signal 30 are output substantially in different frequency bands, e.g. as illustrated in FIGS. 2-4, respectively.

The estimate of the target signal 26 is added to the estimate of the masker signal 30, at least one of which is frequency modified, in a first adder 42 and the output sum is input to an output transducer 48 that converts the output of first adder 42 into an acoustic output signal that is transmitted towards the eardrum of the user wearing the binaural hearing aid system 10.

Further, the estimate of the target signal 26 is subtracted; corresponding to a phase shift of 180°, from the estimate of the masker signal 30, at least one of which is frequency modified, in a second adder 50, and the output of the second adder 50 is transmitted to output transducer 48B for conversion into an acoustic output signal that is transmitted towards the other eardrum of the user wearing the binaural hearing aid system 10. In this way, the BMLD and SRT are improved.

The estimate of the target signal 26 and the estimate of the masker signal 30 may be swapped so that the estimate of the masker signal 20 is phase shifted 180° before presentation to one of the eardrums of the user instead of phase shifting the estimate of the target signal 26. The improvement in BMLD and SRT obtained in this way is smaller than the improvement obtained by phase shift of the estimate of the target signal 26.

The signal separation unit 12 may be configured to provide the estimate based on time-domain, spectral, and/or statistical characteristics of the microphone audio signal as is well-known in the art of noise reduction. Optionally, further processing may be applied to the respective signals before input to the respective receivers 48, 48B, e.g. for hearing loss compensation of the respective signals as is well-known in the art of hearing aids.

Figure 6:
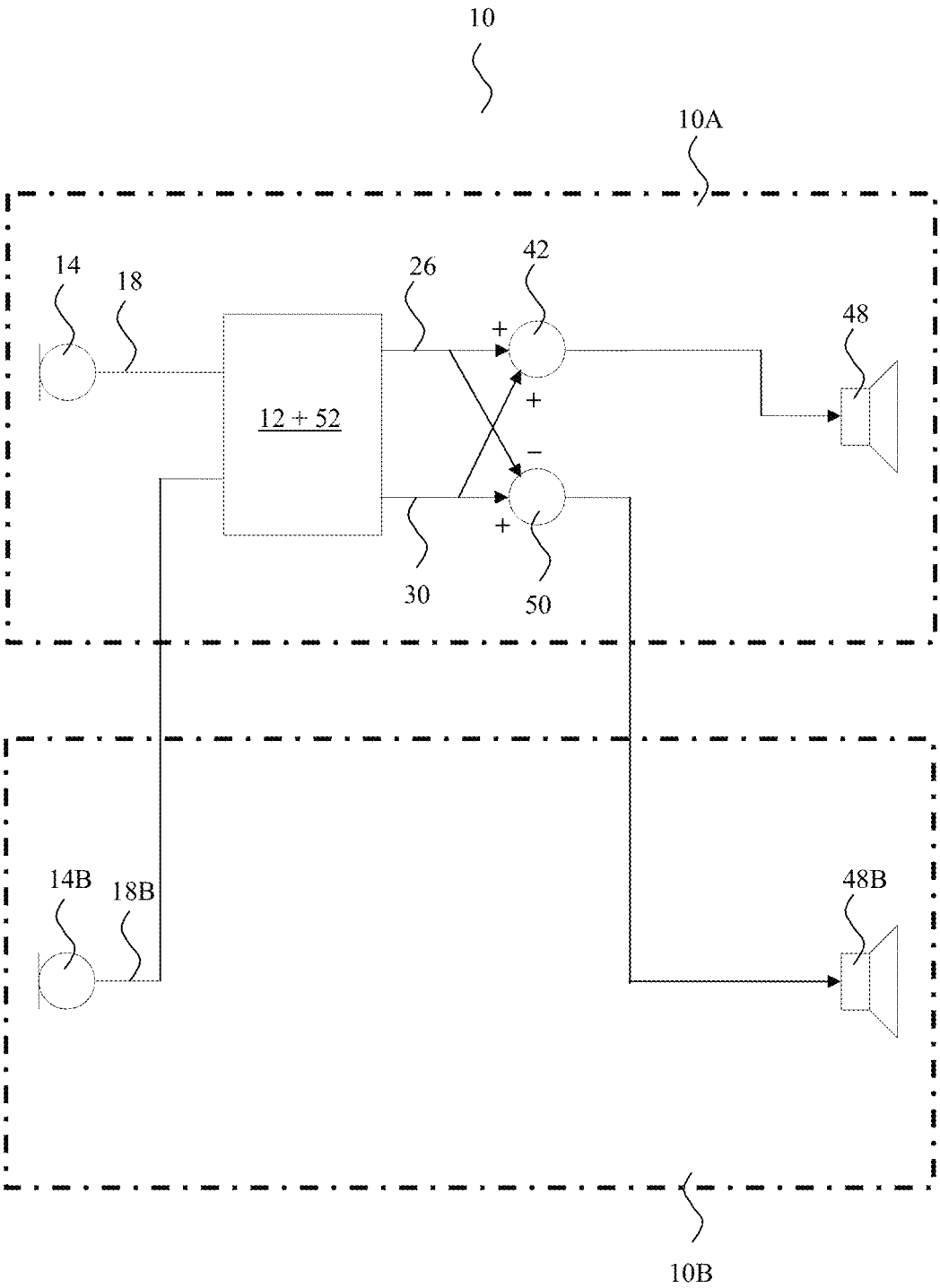

The new binaural hearing aid system 10 shown in FIG. 6 is similar to the hearing aid system shown in FIG. 5 except for the fact that a microphone audio signal 18B output by a microphone 14B in the second hearing aid 10B is transmitted by wired or wireless transmission to the first hearing aid 10A and input to the signal separation unit 12 so that the signal separation unit 12 can base the estimate of the target signal and the estimate of the masker signal 30 on both, possibly pre-filtered, microphone audio signals 18, 18B, e.g. by beamforming as explained further below. The relatively large distance between the microphones 14, 14B, when a user wears the first and second hearing aids 10A, 10B in their intended positions at the respective ears of the user, makes it possible to form a narrow beam and therefore allow a good spatial separation of the target signal from the masker signal.

The frequency modifying unit 52 modifies the frequency content of the estimates of the target signal 26 and the masker signal 30 so that the estimated target signal 26 and the estimated masker signal 30 are output substantially in different frequency bands, e.g. as illustrated in FIGS. 2-4, respectively.

The estimate of the target signal 26 is added to the estimate of the masker signal 30, at least one of which is frequency modified, in a first adder 42 and the output sum is input to an output transducer 48 that converts the output of first adder 42 into an acoustic output signal that is transmitted towards the eardrum of the user wearing the binaural hearing aid system 10.

Further, the frequency modified estimate of the target signal 26 is subtracted; corresponding to a phase shift of 180°, from the estimate of the masker signal 30, at least one of which is frequency modified, in a second adder 50, and the output of the second adder 50 is transmitted to output transducer 48B for conversion into an acoustic output signal that is transmitted towards the other eardrum of the user wearing the binaural hearing aid system 10. In this way, the BMLD and SRT are improved.

The estimate of the target signal 26 and the estimate of the masker signal 30 may be swapped so that the estimate of the masker signal 20 is phase shifted 180° before presentation to one of the eardrums of the user instead of phase shifting the estimate of the target signal 26. The improvement in BMLD and SRT obtained in this way is smaller than the improvement obtained by phase shift of the estimate of the target signal 26.

The signal separation unit 12 may be configured to provide the estimate based on time-domain, spectral, and/or statistical characteristics of the microphone audio signal as is well-known in the art of noise reduction. Optionally, further processing may be applied to the respective signals before input to the respective receivers 48, 48B, e.g. for hearing loss compensation of the respective signals.

Figure 7:
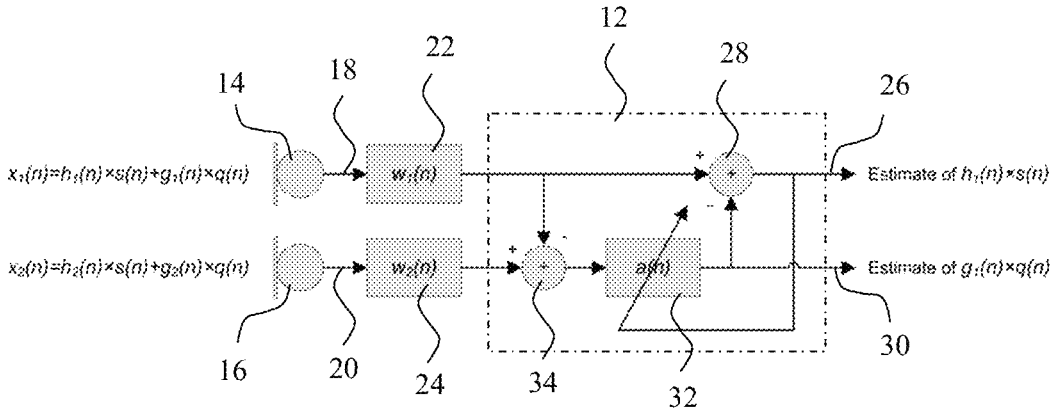

FIG. 7 schematically illustrates a digital signal separation unit 12 including an adaptive beamformer 10 with two microphones 14, 16.

The microphone audio signals 18, 20 are pre-filtered in conventional pre-filters 22, 24 before beamforming. The microphone audio signals 18, 20 may be digitized before or after the pre-filters 22, 24 by ND converters (not shown). Signals before and after pre-filtering and before and after analogue-digital conversion are all termed microphone audio signals.

The output 26 of first subtractor 28 generates the estimate of the target signal from the assumed target direction using adaptive beamforming. The estimate of the target signal 26 is subsequently presented to one of the two ears of the user and in opposite phase to the other of the two ears of the user. The output 30 of the adaptive filter 32 filtering the output of second subtractor 34 generates the masker signal estimate for subsequent presentation to both ears of the user.

The input $x_1(n)$ to the first microphone 14 is given by:

$$x_1(n)=h_1(n)*s(n)+g_1(n)*q(n)$$

where $h_1(n)$ is the impulse response of sound propagation from the source emitting the signal s(n) to the first microphone 14 and $g_1(n)$ is the impulse response of sound propagation from the masker signal source emitting the signal q(n) to the first microphone 14.

The input $x_2(n)$ to the second microphone 16 is given by:

$$x_2(n)=h_2(n)*s(n)+g_2(n)*q(n)$$

where $h_2(n)$ is the impulse response of sound propagation from the source emitting the signal s(n) to the second microphone 16 and $g_2(n)$ is the impulse response of sound propagation from the masker signal source emitting the signal q(n) to the second microphone 16.

Then, the output 26 of the target signal is equal to $h_1(n)*s(n)$, and the output 30 of the masker signal estimate is equal to $g_1(n)*q(n)$.

Figure 8:
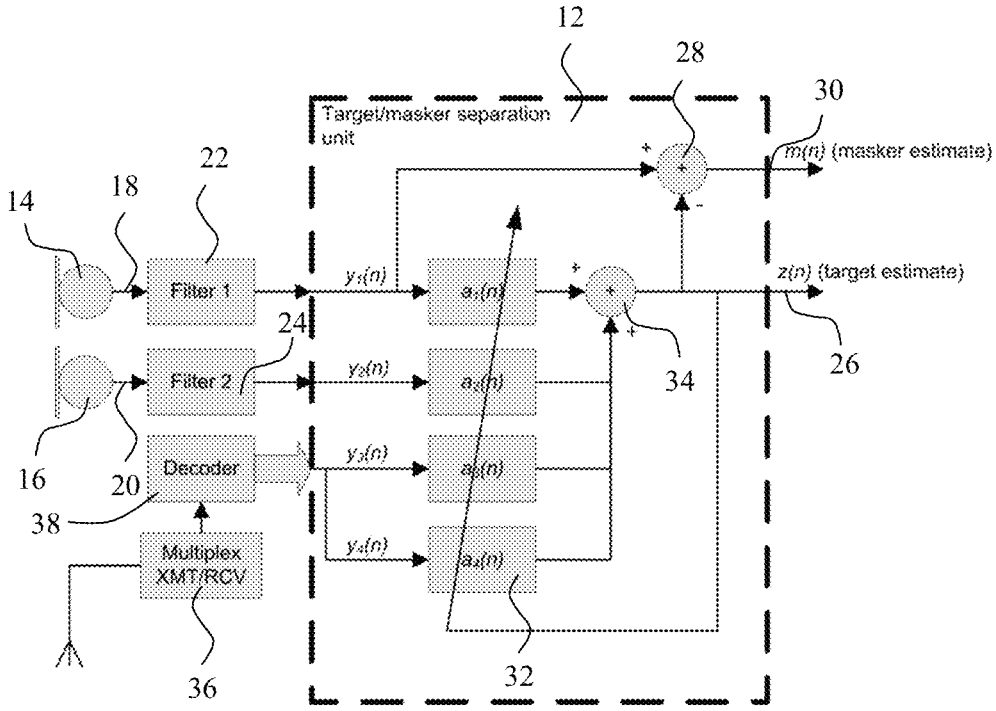

FIG. 8 schematically illustrates a signal separation unit 12 based on four microphones 14, 16, 14B, 16B, two of which 14, 16 are located in the first hearing aid 10A and other two of which (not shown) 14B, 16B are located in the second hearing aid 10B (not shown).

The increased distance between the microphones may be utilized to form a directional pattern with a narrow beam providing improved spatial separation of the target estimate from the masker signal estimate. The conventional output of the beamformer may be used as the target estimate, and the masker signal estimate may be provided by subtraction of the target estimate from the microphone audio signal of one of the microphones of the plurality of microphones.

The microphone audio signals 18, 20 of the two microphones 22, 24 of the first hearing aid 10 are pre-filtered in respective pre-filters 22, 24 well-known in the art, into microphone audio signals $y_1(n)$, $y_2(n)$ and input to respective adaptive filters $a_1(n)$, $a_2(n)$.

The pre-filtered microphone audio signals of the two microphones 14B, 16B (not shown) of the second hearing aid 10B (not shown) are encoded for transmission in the second hearing aid 10B (not shown) and transmitted to the first hearing aid 10A using wireless or wired data transmission. The transmitted data representing the microphone audio signals of the two microphones 14B, 16B (not shown) of the second hearing aid 10B are received by the transceiver 36 of the first hearing aid 10A and decoded in decoder 38 into two microphone audio signals $y_3(n)$, $y_4(n)$ and input to respective adaptive filters $a_3(n)$, $a_4(n)$.

The adaptive filters $a_1(n)$, $a_2(n)$, $a_3(n)$, $a_4(n)$ are configured to filter the respective microphone audio signals $y_1(n)$, $y_2(n)$, $y_3(n)$, $y_4(n)$ and to adapt the respective filter coefficients for adaptive beamforming towards a sound source.

The adaptable filters $a_1(n)$, $a_2(n)$, $a_3(n)$, $a_4(n)$ make it possible to focus on a moving sound source or to focus on a non-moving sound source, while the user of the hearing aid system is moving. Furthermore, the adaptable filters $a_1(n)$, $a_2(n)$, $a_3(n)$, $a_4(n)$ are capable of adapting to changes in the sound environment, such as appearance of a new sound source, disappearance of a masker signal or noise source or movement of masker signal or noise sources relative to the user of the hearing aid system.

The adaptive beamformer filters $a_1(n)$, $a_2(n)$, $a_3(n)$, $a_4(n)$ are designed under the assumption that the signals received at the at least one microphone 14, 16, 14B, 16B can be modelled as a combination of a target signal from a pre-determined target direction plus noise:

$$y_i(n)=h_i(n)*s(n)+v_i(n)$$

where $h_i(n)$ is the impulse response of sound propagation from the source emitting the signal s(n) to the $i^{th}$ microphone and $v_i(n)$ is the noise signal at the same microphone. The masker signal can consist of both directional masker signal or noise and other types of masker signals or noise, such as diffuse noise or babble noise.

The filter coefficients may adaptively be determined by solving the following optimization problem:

$$\{a_i(n)\}_{i=1}^{4} = \arg\min_{\{a_i(n)\}_{i=1}^{4}} \|z(n)\|^2$$

subject to $$\sum_{i=1}^{4} a_i(n) * h_i(n) = h_1(n)$$

Filter adaptation is preferably performed using the least mean square (LMS) algorithm, more preferred the normalized least means square (NLMS) algorithm; however other algorithms may also be used, such as recursive least square, steepest descent or other types of numerical optimization algorithms.

The outputs of the adaptive filters $a_1(n)$, $a_2(n)$, $a_3(n)$, $a_4(n)$ are added in adder 34, and the output 26 of adder 34 constitutes the estimate of the target signal $$z(n)=h_1(\widehat{n})*s(n).$$

Subtractor 28 outputs an estimate of the masker signal:

$$\widehat{v_1(n)}=y_1(n)-z(n).$$

Once the target and masker signal estimates have been determined, the signals are presented to the user in such a way that the SRT of the user is improved as schematically illustrated in FIG. 7.

Figure 9:
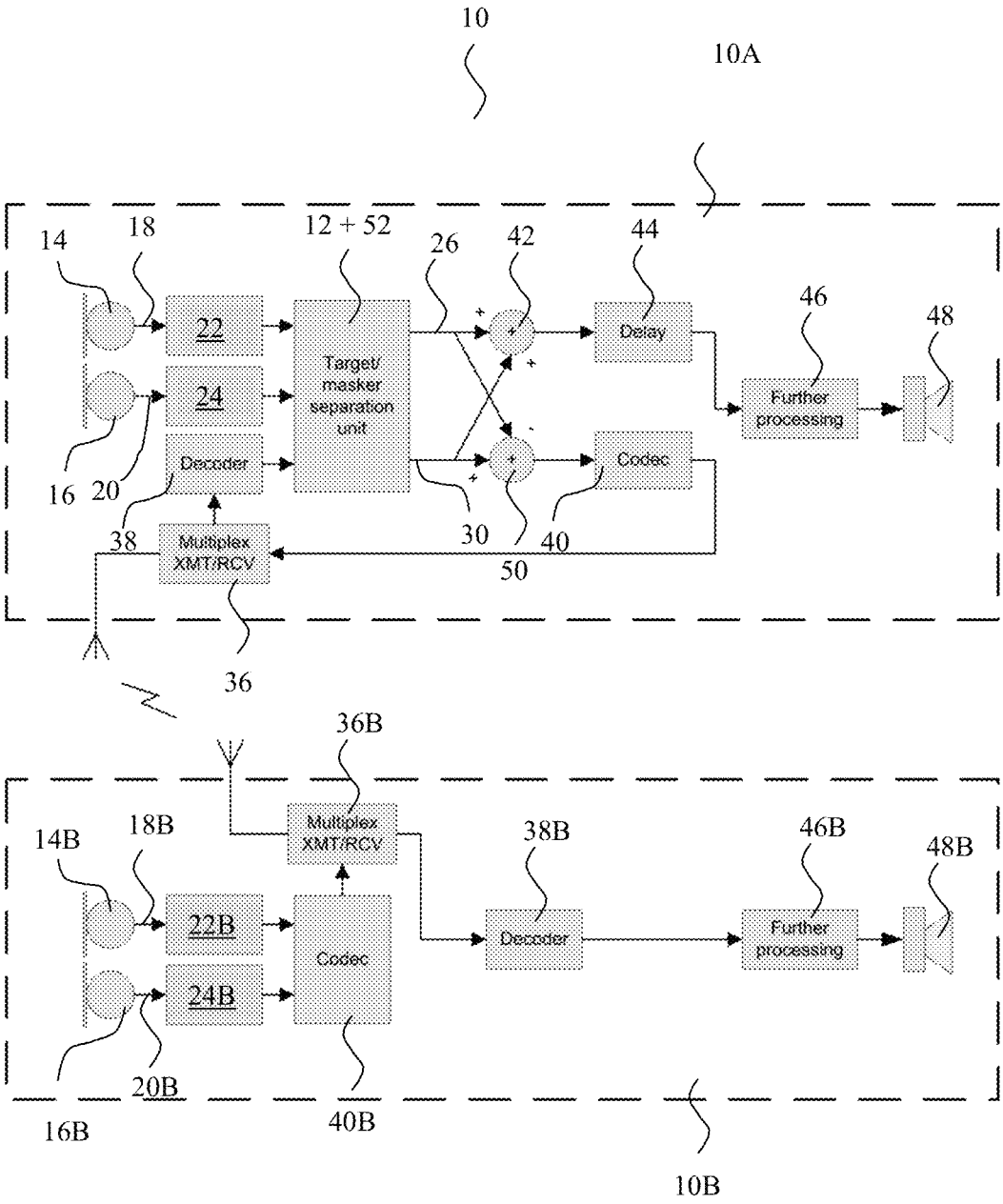

FIG. 9 shows an example of the new binaural hearing aid system 10.

The new binaural hearing aid system 10 has first and second hearing aids 10A, 10B with transceivers 36, 36B for data communication between the two hearing aids 10A, 10B. The first hearing aid 10A comprises at least one microphone with two microphones 14, 16 for provision of microphone audio signals 18, 20 in response to sound received at the respective microphones 14, 16. The microphone audio signals 18, 20 are pre-filtered in respective pre-filters 22, 24 well-known in the art, into microphone audio signals and input to the signal separation unit 12. The signal separation unit 12 is shown in more detail in FIG. 8 and explained above with reference to FIG. 8.

The second hearing aid 10B also comprises at least one microphone with two microphones 14B, 16B for provision of microphone audio signals 18B, 20B in response to sound received at the respective microphones 14B, 16B. The microphone audio signals 18B, 20B are pre-filtered by pre-filters 22B, 24B as is well-known in the art. Then the pre-filtered microphone audio signals of the two microphones 22B, 24B are encoded in Codec 40B for transmission to the first hearing aid 10A using wireless data transmission. The transmitted data representing the microphone audio signals of the second hearing aid 10B are received by the transceiver 36 of the first hearing aid 10A and decoded in decoder 38 into two microphone audio signals that are input to the signal separation unit 12 as explained above with reference to FIG. 8.

The signal separation unit 12 is configured to provide the estimate of the target signal 26 and the estimate of the masker signal 30 based on the pre-filtered microphone audio signals of the first and second hearing aids 10A, 10B.

The relatively large distance between the microphones of the individual hearing aids 10A, 10B as compared to the distance between microphones of a single hearing aid, makes it possible to configure the beamformer of the signal separation unit 12, see FIG. 8, with a narrow beam directional pattern providing improved spatial separation of the estimate of the target signal 26 from the estimate of the masker signal 30. The conventional output of the beamformer is used as the estimate of the target signal 26, and the estimate of the masker signal 30 is provided by subtraction of the estimate of the target signal 26 from the pre-filtered microphone audio signal of one of the microphones of the plurality of four microphones 14, 16, 14B, 16B.

Once the target and masker signal estimates have been determined, the signals are presented to the user in such a way that the SRT of the user is improved: The estimate of the target signal 26 is added to the estimate of the masker signal 30, at least one of which is frequency modified, in a first adder 42 and the output sum of the estimate of the target signal 26 and the estimate of the masker signal 30 is delayed in delay 44 and input to a signal processor 46 for hearing loss compensation. The delay 44 maintains the desired relative phase of the signals output by the first and second hearing aids 10A, 10B, respectively.

An output transducer 48, in the illustrated example a receiver 48, converts the output of the signal processor 46 into an acoustic output signal that is transmitted towards the eardrum of the user wearing the binaural hearing aid system 10.

Further, the estimate of the target signal 26 is subtracted; corresponding to a phase shift of 180°, from the estimate of the masker signal 30, at least one of which is frequency modified, in a second adder 50, and the output of the second adder 50 is encoded in Codec 40 for transmission by transceiver 36 to the second hearing aid 10B. In the second hearing aid 10B the transmitted sum is received by the transceiver 36B and decoded by decoder 38B and input to signal processor 46B for hearing loss compensation. An output transducer 48B, in the illustrated example a receiver 48B, converts the output of the signal processor 46B into an acoustic output signal that is transmitted towards the eardrum of the user wearing the binaural hearing aid system 10. In this way, the SRT of the user may be improved up to 20 dB depending on the sound environment.

The estimate of the target signal 26 and the estimate of the masker signal 30 may be swapped so that the estimate of the masker signal 20 is phase shifted 180° before presentation to one of the eardrums of the user instead of phase shifting the estimate of the target signal 26. The improvement in SRT obtained in this way is smaller than the improvement obtained by phase shift of the estimate of the target signal 26.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

at least one microphone for provision of at least one microphone audio signal in response to sound received at the at least one microphone;

a signal separation unit configured to provide an estimate of a target signal and an estimate of a masker signal based on the at least one microphone audio signal;

a frequency modifying unit configured to modify a frequency content of the estimate of the target signal, the estimate of the masker signal, or both the estimate of the target signal and the estimate of the masker signal, wherein the frequency modifying unit is also configured to output the estimated target signal and the estimated masker signal substantially in different frequency bands; and a receiver for conversion of a combination of the estimate of the target signal and the estimate of the masker signal output by the frequency modifying unit into an acoustic signal for transmission towards an eardrum of a user of the hearing aid;

wherein the frequency modifying unit is configured to: determine pitch and harmonics of the estimate of the target signal and the estimate of the masker signal, respectively, and frequency shift one of the estimate of the target signal and the estimate of the masker signal to obtain a frequency shifted estimate, so that pitch and harmonics of the frequency shifted estimate resides in between respective pitch and harmonics of the other one of the estimate of the target signal and the estimate of the masker signal.

2. A binaural hearing aid system, comprising:

a first hearing aid comprising:

at least one microphone for provision of at least one microphone audio signal in response to sound received at the at least one microphone;

a signal separation unit configured to provide an estimate of a target signal and an estimate of a masker signal based on the at least one microphone audio signal;

a frequency modifying unit configured to modify a frequency content of the estimate of the target signal, the estimate of the masker signal, or both the estimate of the target signal and the estimate of the masker signal, wherein the frequency modifying unit is also configured to output the estimated target signal and the estimated masker signal substantially in different frequency bands; and a receiver for conversion of a combination of the estimate of the target signal and the estimate of the masker signal output by the frequency modifying unit into an acoustic signal for transmission towards an eardrum of a user of the hearing aid; and a second hearing aid comprising:

at least one microphone for provision of at least one microphone audio signal in response to sound received at the at least one microphone of the second hearing aid; and a transceiver for transmission of signals representing the at least one microphone audio signal from the at least one microphone of the second hearing aid to the first hearing aid;

wherein the first hearing aid comprises a transceiver for reception of the signals representing the at least one microphone audio signal of the second hearing aid; and wherein the signal separation unit is configured to provide the estimate of the target signal and the estimate of the masker signal based on the at least one microphone audio signal from the at least one microphone of the first hearing aid, and the at least one microphone audio signal from the at least one microphone of the second hearing aid.

3. The first hearing aid according to claim 1, wherein the frequency modifying unit is configured to frequency shift one of the estimate of the target signal and the estimate of the masker signal into a frequency region where the other one of the estimate of the target signal and the estimate of the masker signal substantially is not present.

4. The first hearing aid according to claim 1, wherein the frequency modifying unit comprises a filter-bank; and wherein the frequency modifying unit is configured to:

filter the estimate of the target signal with frequency bands assigned to the estimate of the target signal, and filter the estimate of the masker signal with other frequency bands assigned to the estimate of the masker signal.

5. A hearing aid comprising:

at least one microphone for provision of at least one microphone audio signal in response to sound received at the at least one microphone;

a signal separation unit configured to provide an estimate of a target signal and an estimate of a masker signal based on the at least one microphone audio signal;

a frequency modifying unit configured to modify a frequency content of the estimate of the target signal, the estimate of the masker signal, or both the estimate of the target signal and the estimate of the masker signal, wherein the frequency modifying unit is also configured to output the estimated target signal and the estimated masker signal substantially in different frequency bands; and a receiver for conversion of a combination of the estimate of the target signal and the estimate of the masker signal output by the frequency modifying unit into an acoustic signal for transmission towards an eardrum of a user of the hearing aid;

wherein the frequency modifying unit comprises a filter-bank;

wherein the frequency modifying unit is configured to: filter the estimate of the target signal with frequency bands assigned to the estimate of the target signal, and filter the estimate of the masker signal with other frequency bands assigned to the estimate of the masker signal; and wherein the filter-bank is tuned to auditory filters for the user.

6. The first hearing aid according to claim 1, further comprising:

a phase shift circuit configured to phase shift one of the estimate of the target signal and the estimate of the masker signal with relation to the other one of the estimate of the target signal and the estimate of the masker signal.

7. The first hearing aid according to claim 1, wherein the signal separation unit is configured to provide the estimates based on spectral characteristics of the audio signals.

8. The first hearing aid according to claim 1, wherein the signal separation unit is configured to provide the estimates based on statistical characteristics of the audio signals.

9. A hearing aid comprising:

at least one microphone for provision of at least one microphone audio signal in response to sound received at the at least one microphone;

a signal separation unit configured to provide an estimate of a target signal and an estimate of a masker signal based on the at least one microphone audio signal;

a frequency modifying unit configured to modify a frequency content of the estimate of the target signal, the estimate of the masker signal, or both the estimate of the target signal and the estimate of the masker signal, wherein the frequency modifying unit is also configured to output the estimated target signal and the estimated masker signal substantially in different frequency bands; and a receiver for conversion of a combination of the estimate of the target signal and the estimate of the masker signal output by the frequency modifying unit into an acoustic signal for transmission towards an eardrum of a user of the hearing aid;

wherein the frequency modifying unit is configured to frequency shift one of the estimate of the target signal and the estimate of the masker signal into a frequency region where the other one of the estimate of the target signal and the estimate of the masker signal substantially is not present;

wherein the signal separation unit comprises a beamformer.

10. The binaural hearing aid system according to claim 2, wherein the signal separation unit comprises a beamformer configured to provide the estimates based on the at least one microphone audio signal from the at least one microphone of the first hearing aid, and the at least one microphone audio signal from the at least one microphone of the second hearing aid.

11. The binaural hearing aid system according to claim 10, wherein the beam former comprises adaptive filters configured to:

filter the at least one microphone audio signal from the at least one microphone of the first hearing aid, and the at least one microphone audio signal from the at least one microphone of the second hearing aid, to provide output signals, and adapt filter coefficients to minimize a sum of the output signals of the filters.

12. A method of signal enhancement in a hearing aid, comprising:

providing at least one microphone audio signal in response to sound;

providing an estimate of a target signal and an estimate of a masker signal based on the at least one audio signal;

frequency modifying the estimate of the target signal, the estimate of the masker signal, or both the estimate of the target signal and the estimate of the masker signal, so that the estimate of the target signal and the estimate of the masker signal substantially reside in different frequency bands; and transmitting a combination of the estimate of the target signal and the estimate of the masker signal that reside in different frequency bands towards an eardrum of a user of the hearing aid;

wherein the act of frequency modifying comprises: determining pitch and harmonics of the estimate of the target signal and the estimate of the masker signal, respectively, and frequency shifting one of the estimate of the target signal and the estimate of the masker signal to obtain a frequency shifted estimate, so that pitch and harmonics of the frequency shifted estimate resides in between respective pitch and harmonics of the other one of the estimate of the target signal and the estimate of the masker signal.

13. The method of signal enhancement according to claim 12, wherein:

the act of providing the at least one microphone audio signal comprises providing microphone audio signals at respective ears of the user in response to respective sound received at the ears; and the estimate of one of the target signal and the masker signal is provided based on the microphone audio signals at both ears.

14. The method of signal enhancement according to claim 13, further comprising beamforming based on the microphone audio signals.

15. The method of signal enhancement according to claim 13, further comprising adaptive filtering of the microphone audio signals to obtain respective adaptively filtered output signals, wherein the act of adaptive filtering comprises adapting filter coefficients to minimize a sum of the adaptively filtered output signals.

16. The method of signal enhancement according to claim 12, further comprising phase shifting one of the estimate of the target signal and the estimate of the masker signal with relation to the other one of the estimate of the target signal and the estimate of the masker signal.

17. A binaural hearing aid system, comprising:

a first hearing aid according to claim 1; and a second hearing aid comprising:

at least one microphone for provision of at least one microphone audio signal in response to sound received at the at least one microphone of the second hearing aid; and a transceiver for transmission of signals representing the at least one microphone audio signal from the at least one microphone of the second hearing aid to the first hearing aid;

wherein the first hearing aid comprises a transceiver for reception of the signals representing the at least one microphone audio signal of the second hearing aid; and wherein the signal separation unit is configured to provide the estimate of the target signal and the estimate of the masker signal based on the at least one microphone audio signal from the at least one microphone of the first hearing aid, and the at least one microphone audio signal from the at least one microphone of the second hearing aid.

18. The hearing aid according to claim 4, wherein the filter-bank is tuned to auditory filters for the user.

19. The hearing aid according to claim 1, wherein the signal separation unit comprises a beamformer.

20. The binaural hearing aid system according to claim 2, wherein the signal separation unit comprises a beamformer.

* * * * *